US009266670B2

(12) United States Patent
Fjetland

(10) Patent No.: US 9,266,670 B2
(45) Date of Patent: Feb. 23, 2016

(54) LIFTING DEVICE FOR A CONTAINER

(75) Inventor: Geir Tore Fjetland, Sandnes (NO)

(73) Assignee: Jack-Pack AS, Sandnes (NO)

( * ) Notice: Subject to any disclaimer, the term of this patent is extended or adjusted under 35 U.S.C. 154(b) by 66 days.

(21) Appl. No.: 14/007,929

(22) PCT Filed: Mar. 1, 2012

(86) PCT No.: PCT/NO2012/050032
§ 371 (c)(1),
(2), (4) Date: Oct. 30, 2013

(87) PCT Pub. No.: WO2012/138229
PCT Pub. Date: Oct. 11, 2012

(65) Prior Publication Data

US 2014/0054303 A1 Feb. 27, 2014

(30) Foreign Application Priority Data

Apr. 6, 2011 (NO) ..... 20110528

(51) Int. Cl.
*B65D 90/18* (2006.01)
*B65D 90/00* (2006.01)

(52) U.S. Cl.
CPC ..... *B65D 90/18* (2013.01); *B65D 90/0033* (2013.01)

(58) Field of Classification Search
CPC .... B65D 90/18; B65D 90/0033; B65D 90/14; B65D 63/06
See application file for complete search history.

(56) References Cited

U.S. PATENT DOCUMENTS

| | | | | |
|---|---|---|---|---|
| 3,570,694 | A * | 3/1971 | Tantlinger | 414/458 |
| 3,788,683 | A * | 1/1974 | Rumell | 410/66 |
| 3,984,013 | A | 10/1976 | Wirz | |
| 4,452,555 | A * | 6/1984 | Calabro | 410/53 |
| 4,863,334 | A * | 9/1989 | Girerd | 414/458 |
| 5,006,032 | A * | 4/1991 | Riedl et al. | 414/458 |
| 5,806,863 | A * | 9/1998 | Heger et al. | 280/33.998 |

FOREIGN PATENT DOCUMENTS

| | | | |
|---|---|---|---|
| BE | 1009737 | A6 | 7/1997 |
| DE | 33 12 585 | A1 | 10/1984 |
| FR | 2 710 041 | A1 | 3/1995 |
| WO | WO 2014088421 | A1 * | 6/2014 |

OTHER PUBLICATIONS

International Search Report for parent application PCT/NO2012/050032, having a mailing date of Jun. 5, 2012.

(Continued)

*Primary Examiner* — Kaitlin Joerger
(74) *Attorney, Agent, or Firm* — Andrus Intellectual Property Law, LLP

(57) ABSTRACT

A lifting device is for a container. The lifting device is attached at one end of the container. The lifting device includes an undercarriage provided with one or more wheels; and an actuator arranged to move the undercarriage of the lifting device between a first position, not engaging the supporting surface, and a second position, engaging the supporting surface, so that, in the position of the undercarriage engaging the supporting surface, one end of the container is lifted up from the supporting surface. The undercarriage of the lifting device is connected to the actuator via at least one connecting body, the connecting body being connected to the actuator and movable therewith.

12 Claims, 10 Drawing Sheets

(56) References Cited

OTHER PUBLICATIONS

Written Opinion for parent application PCT/NO2012/050032, having a mailing date of Jun. 5, 2012.
Applicant's Reply of Jan. 7, 2013 to Written Opinion for parent application PCT/NO2012/050032, having a mailing date of Jun. 5, 2012.
Written Opinion for parent application PCT/NO2012/050032, having a mailing date of Mar. 19, 2013.
Applicant's Reply of May 16, 2013 to Written Opinion for parent application PCT/NO2012/050032, having a mailing date of Mar. 19, 2013.
International Preliminary Report for parent application PCT/NO2012/050032, having a completion date of Jul. 8, 2013.

* cited by examiner

LIFTING DEVICE FOR A CONTAINER

CROSS-REFERENCE TO RELATED APPLICATIONS

This application is the U.S. national stage application of International Application No. PCT/NO2012/050032, filed Mar. 1, 2012, which international application was published on Oct. 11, 2012 as International Publication No. WO 2012/138229 A1 in the English language and which application is incorporated herein by reference. The International application claims priority of Norwegian Patent Application No. 20110528, filed Apr. 6, 2011, which application is incorporated herein by reference.

BACKGROUND

The invention relates to a lifting device for a container. More specifically, the invention relates to a lifting device with wheels attached to it that is arranged to lift one end of a container, thereby making it possible to move the container locally, for example within a construction site, by means of a tractor, a forklift or some other vehicle or construction site engine.

It is known that heavy transport equipment, such as a hook-lift truck, for example, is provided with the necessary equipment and sufficient power to lift and move a heavy container. As a container is rented, usually the driver of a hook-lift truck will place the container in a given location at a construction site, and leave it there. The container is picked up when it is full or according to agreement. The drawback of this arrangement is that the container, as it fills, becomes too heavy to be moved by smaller construction site equipment such as tractors, forklifts or small excavators. The position of the container is therefore locked to the place in which the driver of the hook-lift truck set it down in the first place. Often, said driver will not be acquainted with the construction site and the position of the container could therefore be unfavourable to the person or persons who are going to use the container or to others working at the same site. Generally, hook-lift trucks are also so large that the ability to navigate is restricted to open areas and relatively broad roads. After a container has been filled, completely or partially, it may be desirable to remove it or change its location within a construction site. This will not be possible today without having to call in a hook-lift truck or the like, as mentioned above, and it will often lead to an unnecessarily long wait and extra costs to have the container moved or removed.

SUMMARY

The invention has for its object to remedy or reduce at least one of the drawbacks of the prior art or at least provide a useful alternative to the prior art.

The object is achieved through features which are specified in the description below and in the claims that follow.

In the present application, the term "container" is meant in a wide sense, so that the term includes all types of containers for the transport and temporary storage of goods, in both solid and liquid forms. It may be, for example, but is not limited to different types of transport containers, hook-lift containers and dump bodies of different sizes and geometries. It is an advantage if a container with a lifting device attached to it, as described in what follows, is provided with one or more wheels at an end of the container opposite an end to which the lifting device is attached. Together with a lifting device according to the invention, this will make it possible for a heavy, fully loaded transport container to be moved locally within a construction site by, for example, but not limited to, a tractor or a construction site engine.

More specifically, this invention relates to a lifting device for a container, the lifting device being attached to one end of the container, and the lifting device including an undercarriage provided with one or more wheels; an actuator arranged to move the undercarriage of the lifting device between a first position, not engaging the supporting surface, and a second position, engaging the supporting surface, so that in the position of the undercarriage engaging the supporting surface, one end of the container is lifted up from the supporting surface, and the lifting device being characterized by the undercarriage of the lifting device being connected to the actuator via at least one connecting body, the connecting body being connected to the actuator and movable therewith.

In one embodiment, the lifting device may include two or more actuators.

In a preferred embodiment, the connecting body may be linearly movable with the actuator, but in an alternative embodiment, the actuator may rotate the connecting body around a shaft, so that the undercarriage is rotated into the position engaging the supporting surface, in which one end of the container is lifted up from the supporting surface.

In another preferred embodiment, as an alternative or in addition, the connecting body and the actuator may be placed, at least partially, within a protective frame.

In one embodiment, a lifting device may be attached to an end surface of the container. This may be, for example, but is not limited to, to a short side of the container. In an alternative embodiment, the lifting device may also be attached to the underside, of the container or to long side. For the different embodiments it is an advantage if the lifting device is positioned and attached, at least partially, inside a recess in the container. Thus, the container may be lifted and transported by existing, standardized lifting and transporting equipment for containers, without it occupying more space than a container without said lifting device. Locating the lifting device inside a recess will also enable tight stacking and packing of several containers with lifting devices.

In a preferred embodiment, the frame and/or connecting body will be formed with a non-cylindrical shape. This may prevent the connecting body from twisting during use. This may be solved, for example, by the connecting body being a rectangular pipe and the frame being adapted to the connecting body.

On its side facing away from the container, the connecting body may further be connected to a bracket, the bracket further being connected to the undercarriage of the lifting device.

In a preferred embodiment, at least in the position engaging the supporting surface, the undercarriage of the lifting device is rotatable around a shaft substantially normal to the supporting surface. This will make it easier to move a container, by the wheels supporting the container at one end of the container being rotatable with the undercarriage so that the container may thereby be turned during transport. The container may, for example, be pulled by a vehicle or construction site engine but may also, in alternative embodiments, be pushed by a vehicle or construction site engine. It is an advantage if the undercarriage is rotatable at least 180° around the shaft substantially normal to the supporting surface, so that the container will have the smallest turning radius possible.

In one embodiment the lifting device may include a tow-bar or the like. This may contribute to facilitating the movement of a container, by the tow-bar being attached to a vehicle. The vehicle may be, for example, but is not limited to, a tractor, a forklift, or a construction site engine. It is an advantage if the tow-bar is attached to the rotatable undercarriage of the lifting device, so that the movement of the container which is being pulled by means of said tow-bar will be as flexible as possible.

In a preferred embodiment, the tow-bar may be adjusted between at least a raised position and a lowered position. This has the advantage of enabling the tow-bar, when not used to pull the container, to be at least partially recessed within the above-mentioned recess as the tow-bar is adjusted into the raised position. In the lowered position, the tow-bar may be used to move the container as mentioned above.

In a further preferred embodiment, on its side facing away from the container in the raised position of the tow-bar, the tow-bar may be provided with a hook connection element. This will enable the use of existing standardized lifting and transporting equipment, such as a hook-lift truck for example, to lift the container onto the hook-lift truck to be transported away from a construction site, for example.

In a further preferred embodiment, the tow-bar may also be formed with en eye, so that the tow-bar may also function as a trailer tow-bar when the undercarriage is in its position engaging the supporting surface, and the tow-bar is in its lowered position.

It may also be an advantage if the tow-bar is arranged to be locked to the container my means of an upper locking device when the tow-bar is in its raised position. This will be particularly appropriate when the tow-bar is provided with the above-mentioned hook connection element on its side facing away from the container. The locking device may lock the tow-bar to the container as the container is being lifted with a hook-lift truck or the like, so that the weight load on the actuator is reduced.

In a preferred embodiment, the locking device includes a first part attached to the container and a second part attached to the tow-bar which is movable by the lifting device. By adjusting the tow-bar into its raised position and at the same time moving the undercarriage up into its position not engaging the supporting surface, the part of the locking device which is attached to the tow-bar may engage the part of the locking device which is attached to the container. The locking device may consist of, for example, a locking rod on the tow-bar, which engages a set of locking dogs on the container as the tow-bar is adjusted into its raised position and the lifting device is moved into its position not engaging the supporting surface. In that connection, it may also be an advantage if the tow-bar is automatically released from the locking device as the undercarriage is moved into its position engaging the supporting surface, so that the tow-bar can freely be lowered and used as the container is being moved.

In a preferred embodiment, the lifting device may also, include a lower locking device arranged to lock the tow-bar to the container in the lowered position of the tow-bar. This will have the advantage of enabling the actuator of the lifting device, to be relieved as the container is being pulled.

In one embodiment, the actuator moving the undercarriage of the lifting device may be a hydraulic cylinder. This may be connected to the hydraulic system take-off of a tractor or construction site engine, for example, in a manner known to a person skilled in the art. In alternative embodiments, the actuator may be of a mechanical or pneumatic type. The actuator may be operated by a worm gear, for example, with power supply from the power take-off of, for example, the above-mentioned vehicles and construction site engines.

A method of lifting one end of a container is described as well, the method utilizing a lifting device attached at one end of the container, the lifting device including an actuator and an undercarriage provided with one or more wheels, characterized by the method including the use of the actuator to move the undercarriage of the lifting device from a first position, not engaging the supporting surface, into a second position, engaging the supporting surface, so that one end of the container is lifted from the supporting surface.

In a preferred embodiment, the method further includes attaching the container to a vehicle and moving the container by means of the vehicle.

BRIEF DESCRIPTION OF DRAWINGS

In what follows, non-limiting examples of preferred embodiments are described, which are visualized in the accompanying drawings, in which.

DETAILED DESCRIPTION OF THE DRAWINGS

Figure 1:
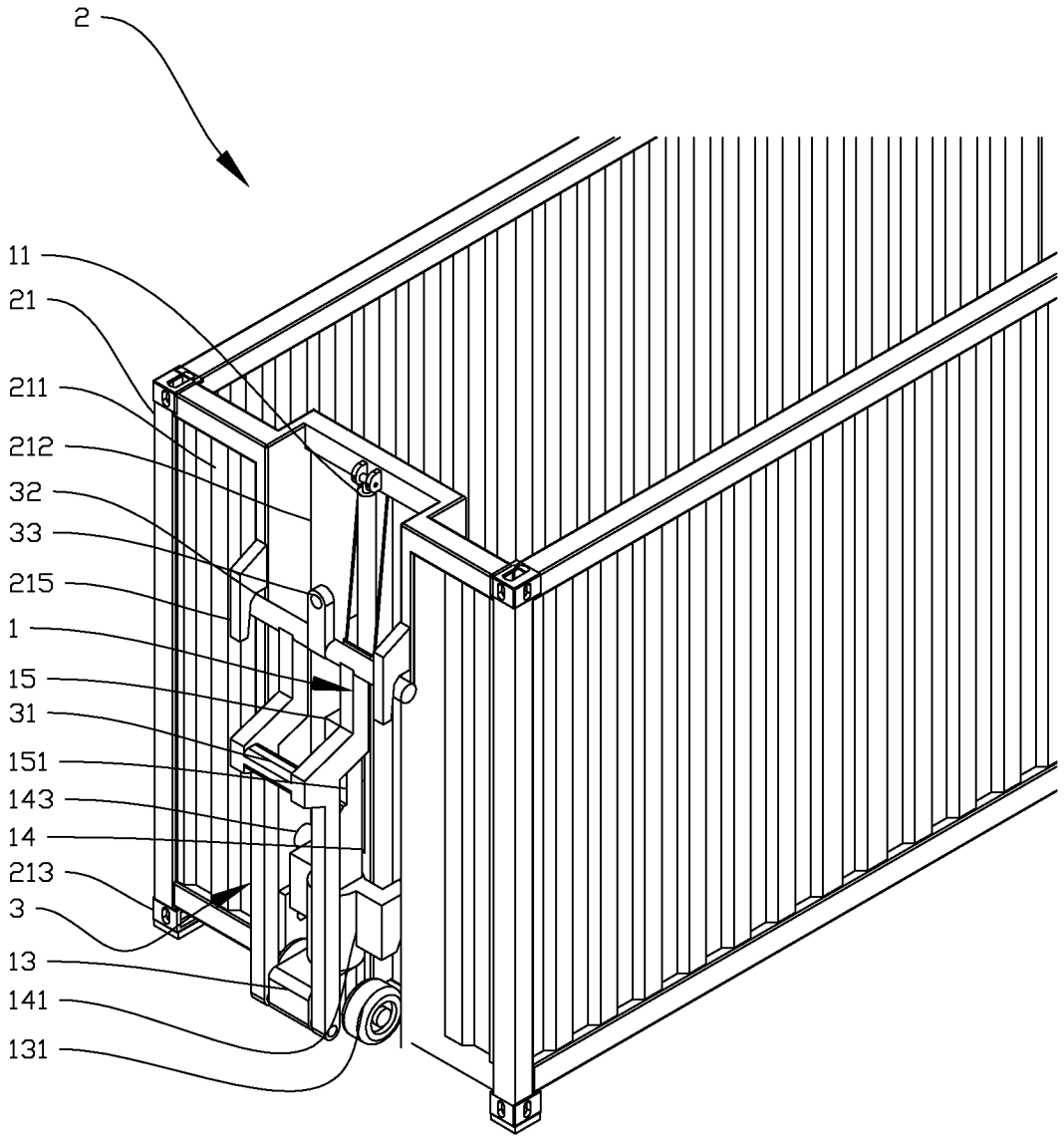
FIG. 1 shows, in perspective, a sketch of a container with a lifting device in the upper position and a tow-bar in a raised position.
Figure 2:
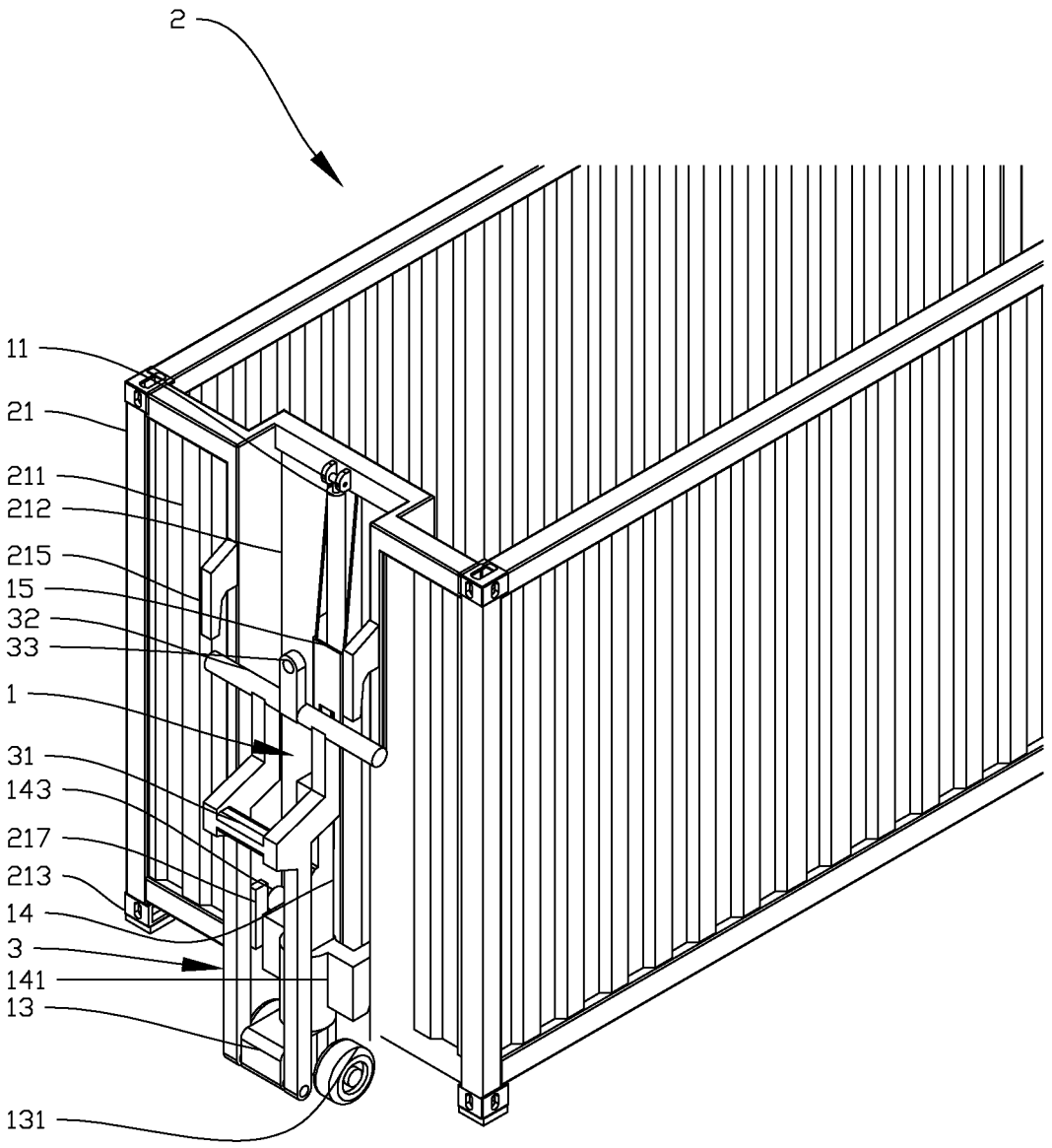
FIG. 2 shows, in perspective, a sketch of a container with a lifting device in a lower position and a tow-bar in a raised position.
Figure 3:
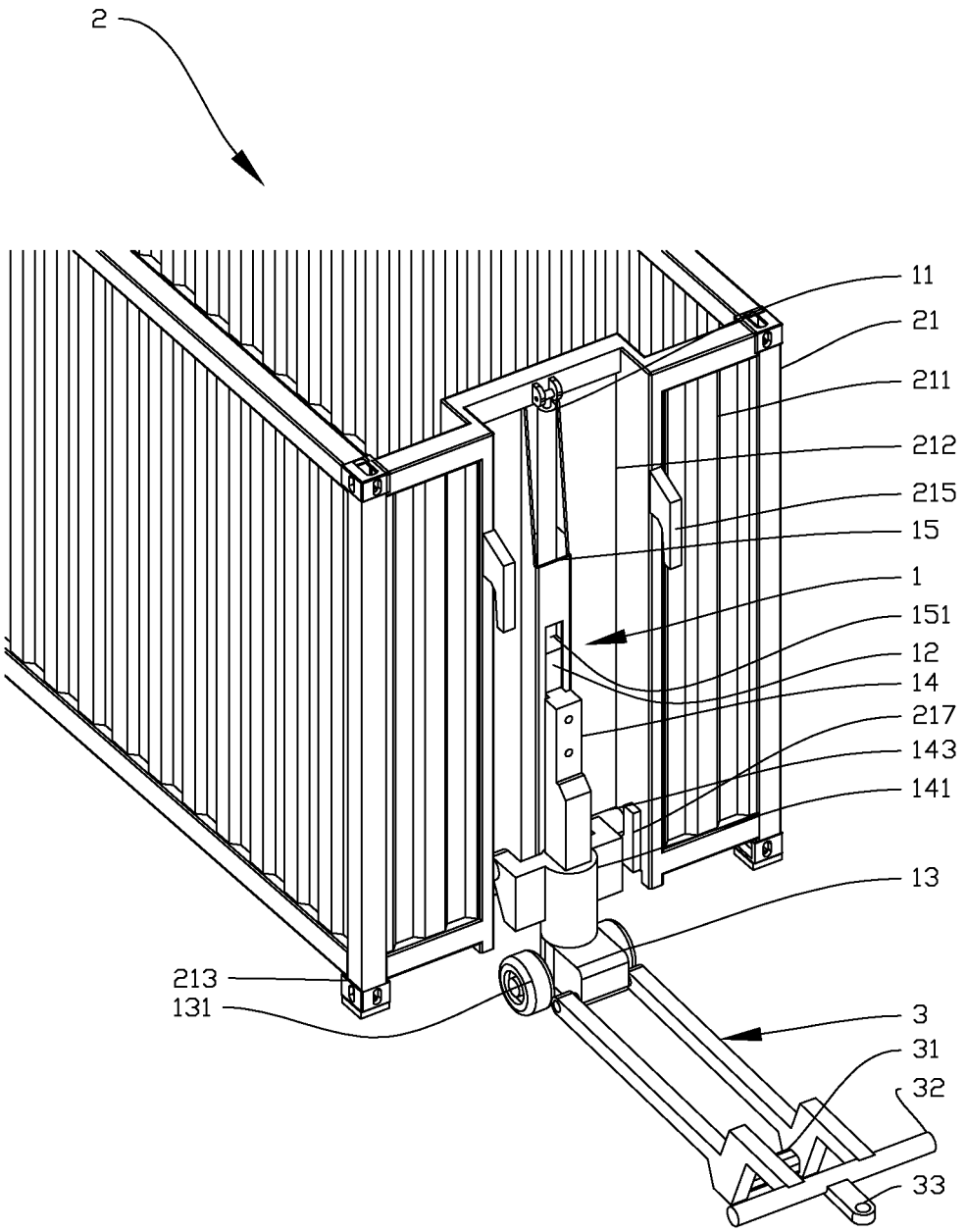
FIG. 3 shows, in perspective, a container with a lifting device in the lower position and a tow-bar in a lowered position.
Figure 4:
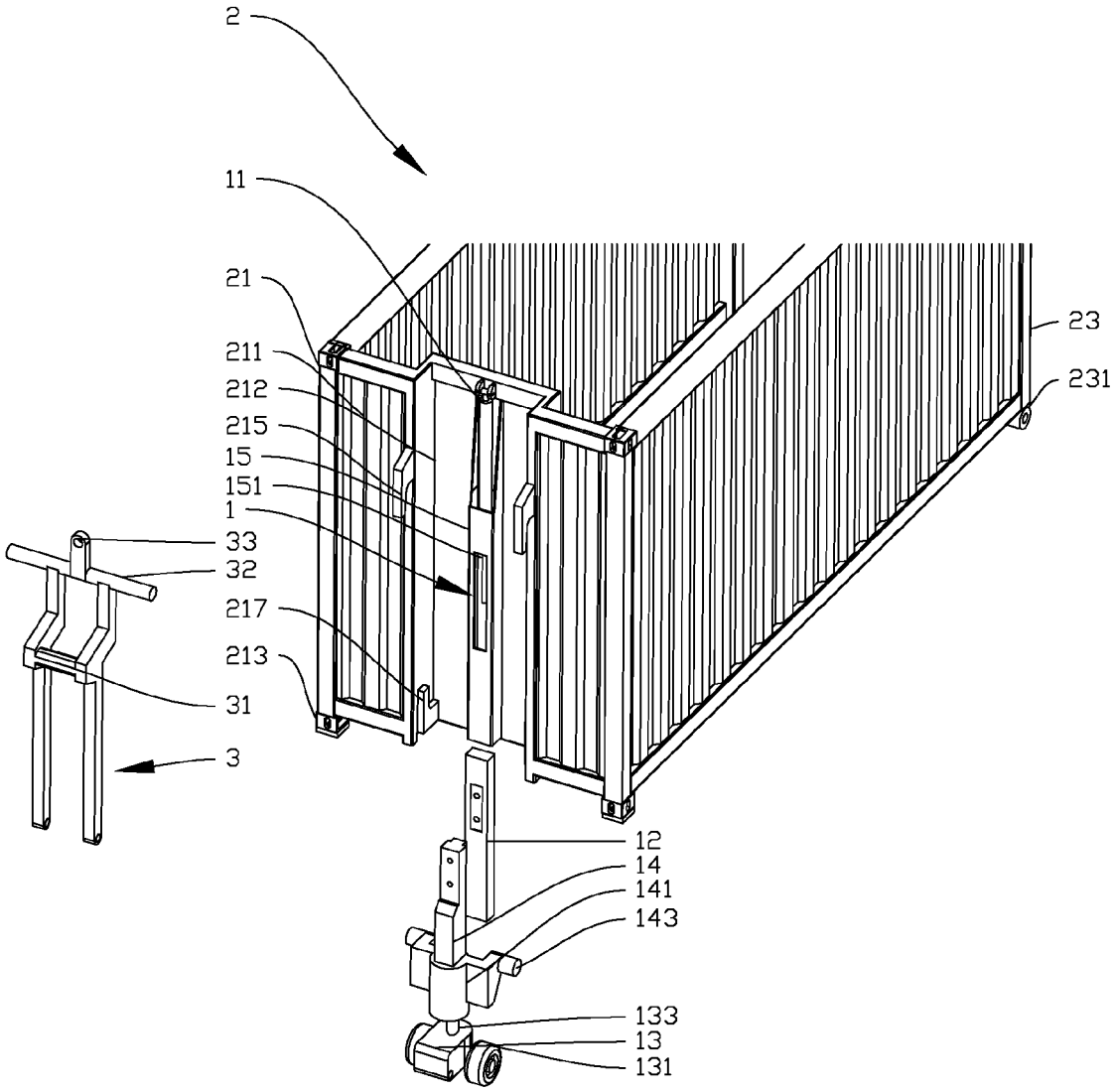
FIG. 4 shows, in perspective, an exploded sketch of a container with a lifting device and a tow-bar.
Figure 5:
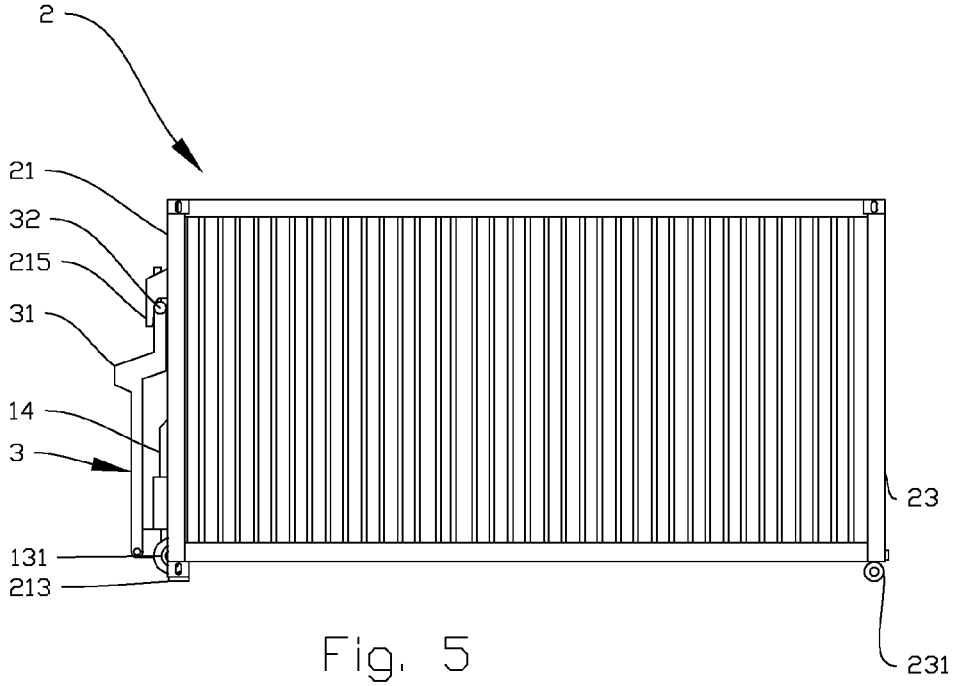
FIG. 5 shows, in a side view, a sketch of a container with a lifting device in the upper position and a tow-bar in the raised position.
Figure 6:
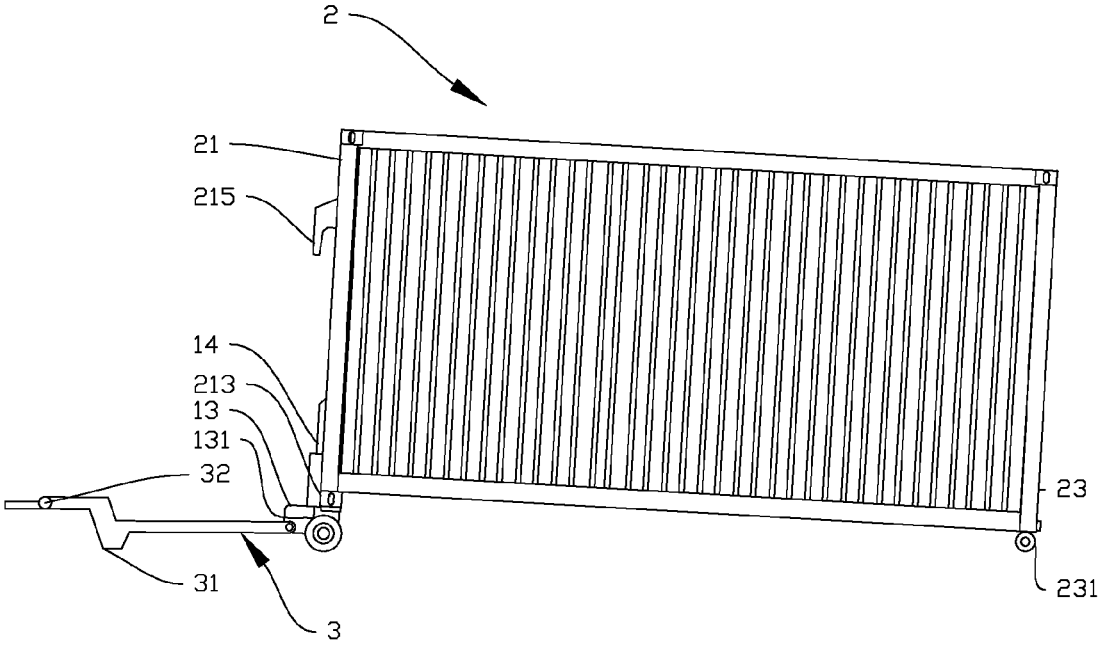
FIG. 6 shows, in a side view, a sketch of a container with a lifting device in lower position and a tow-bar in the lowered position.
Figure 7:
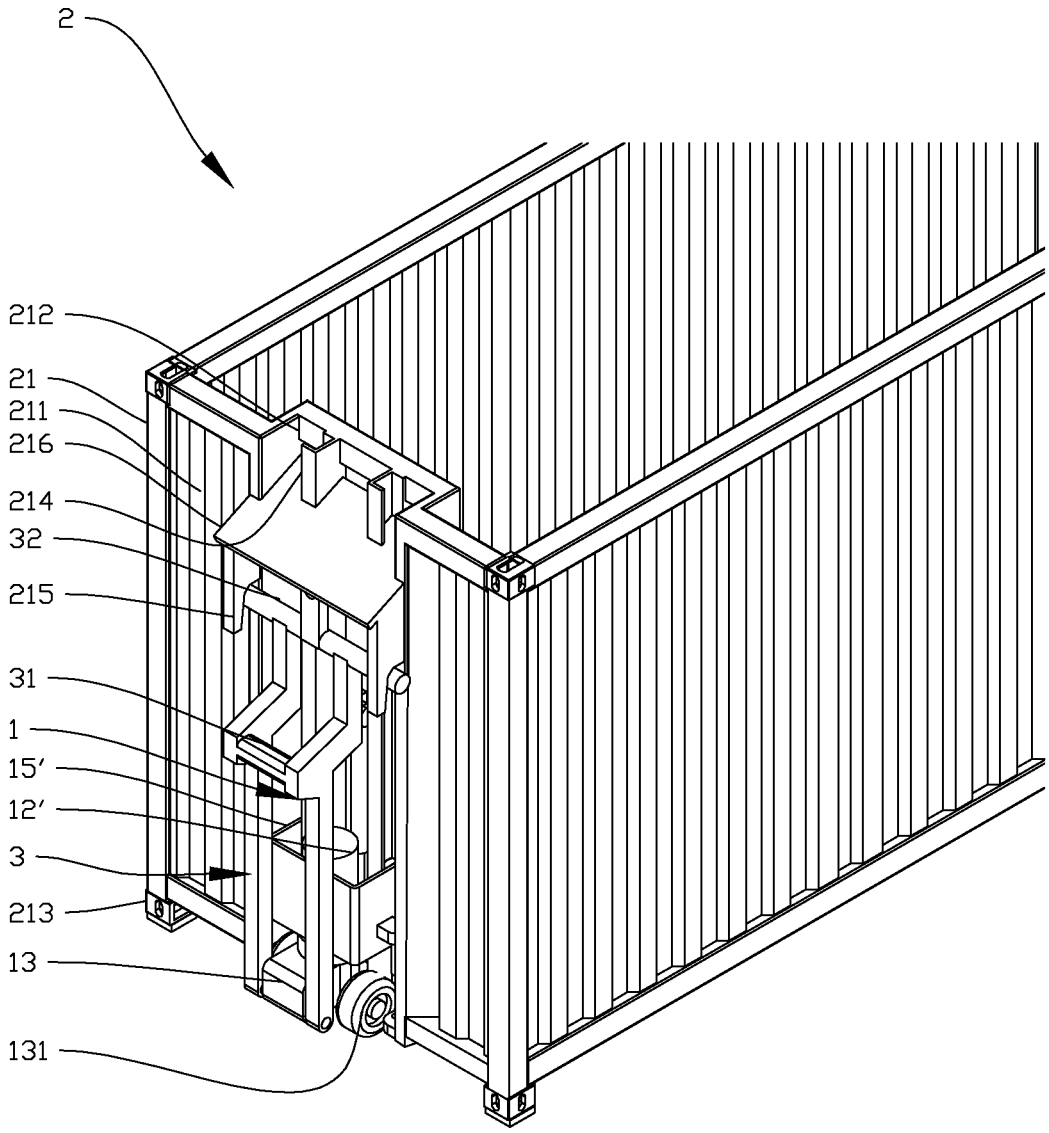
FIG. 7 shows, in perspective, a sketch of an alternative embodiment of a container with a lifting device in the upper position and a tow-bar in the raised position.
Figure 8:
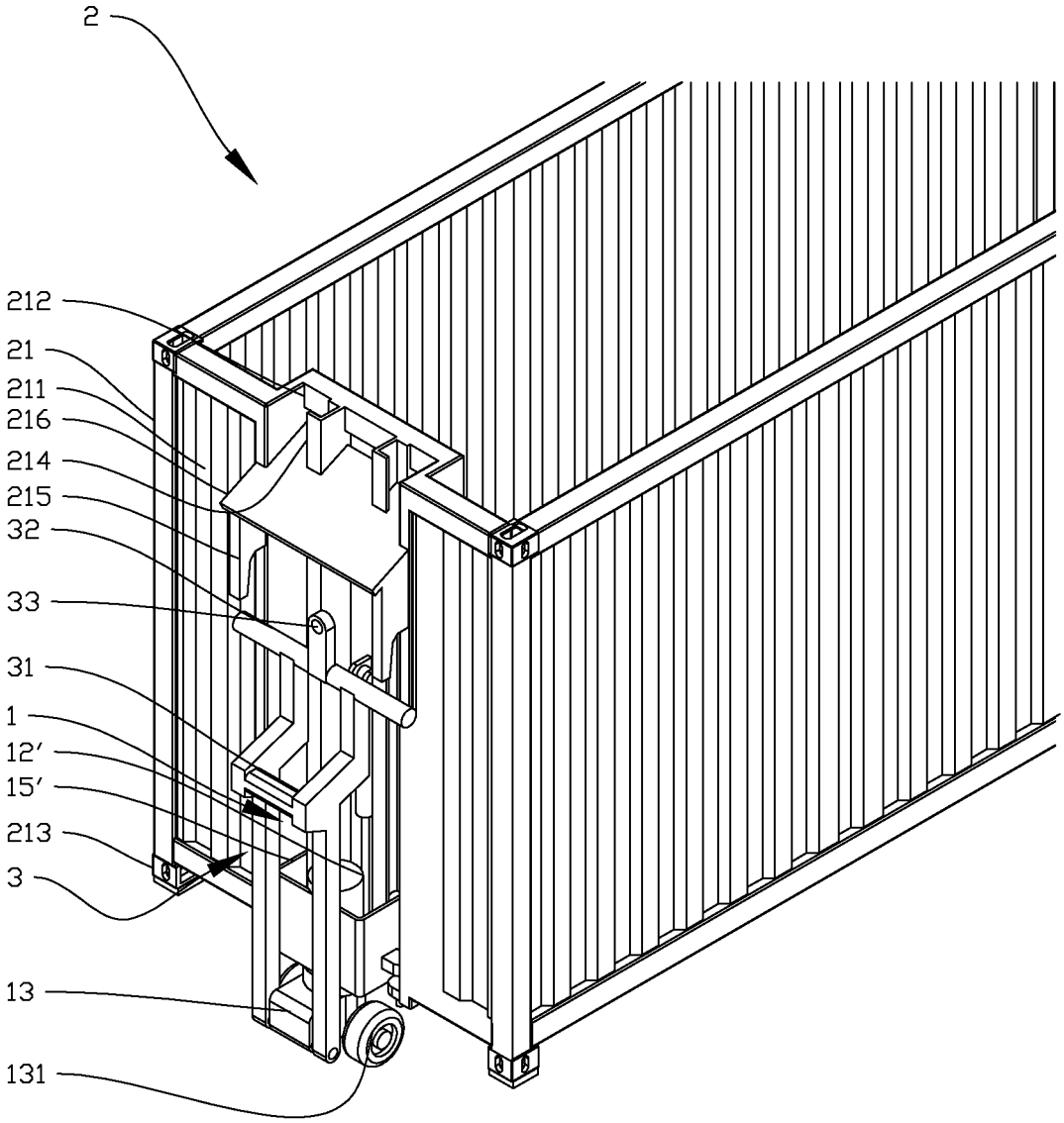
FIG. 8 shows, in perspective, a sketch of the container of FIG. 7 with a lifting device in the lower position and a tow-bar in the raised position.
Figure 9:
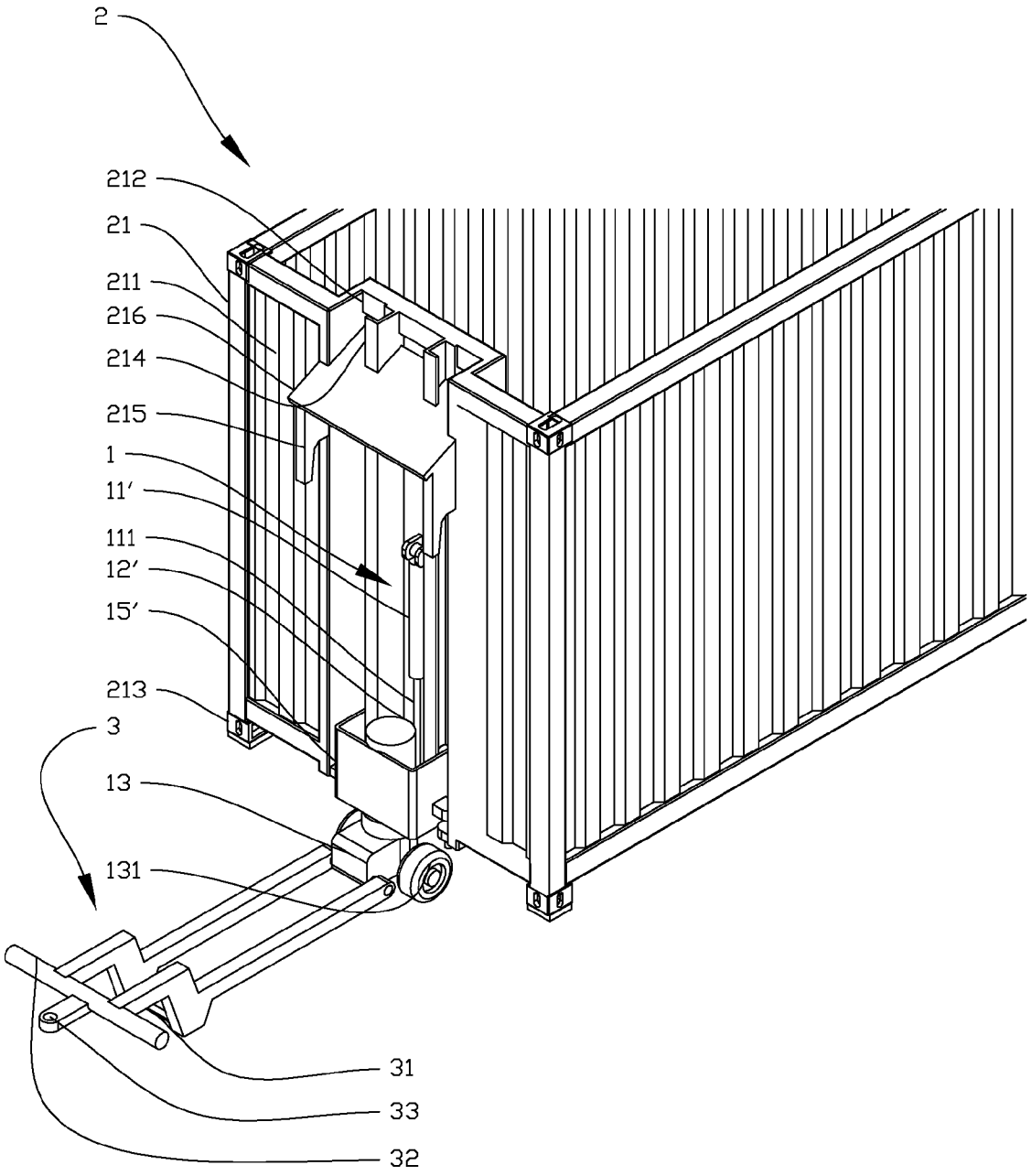
FIG. 9 shows, in perspective, a sketch of the container of FIG. 7 with a lifting device in the lower position and a tow-bar in a lowered position.
Figure 10:
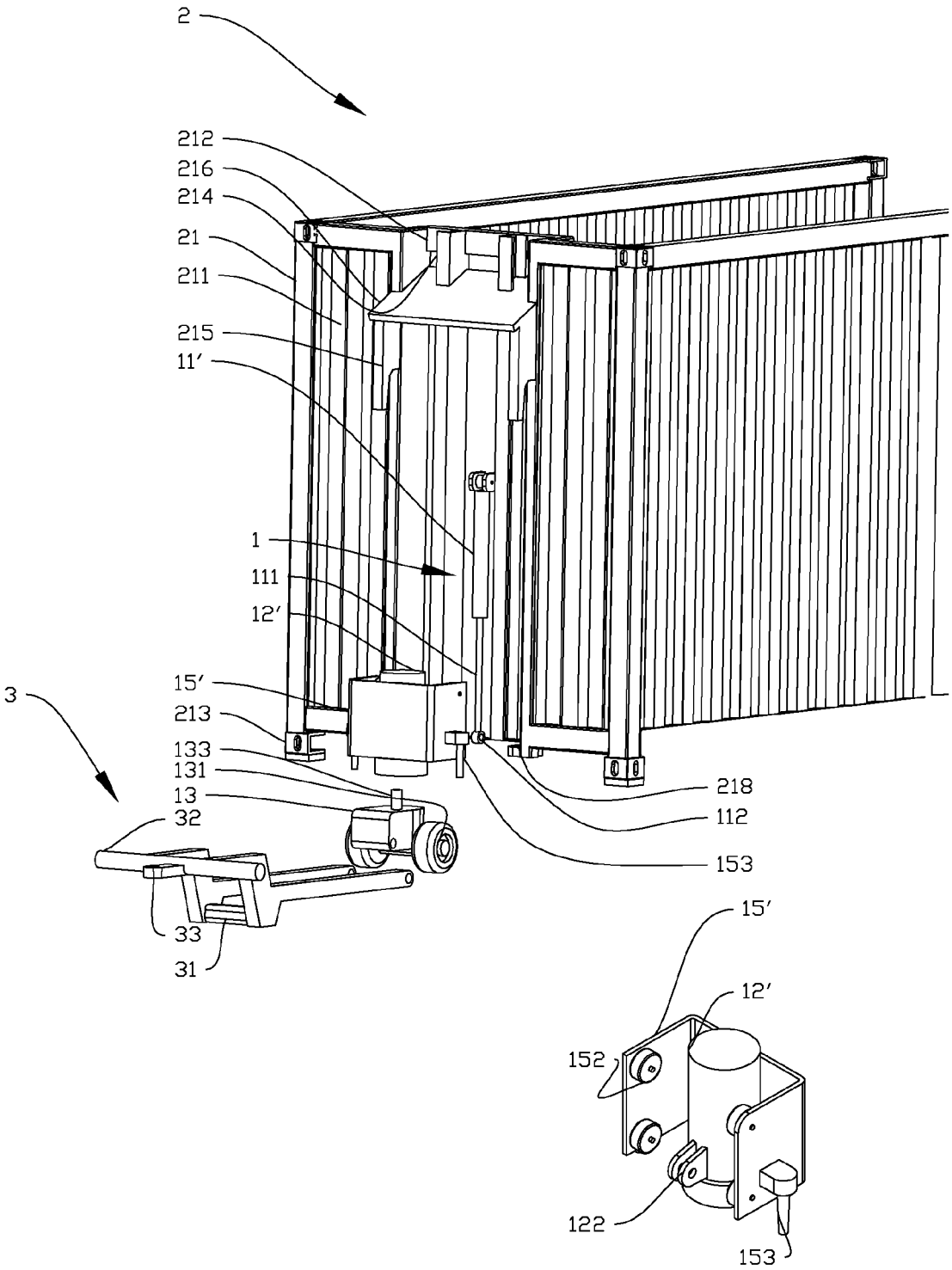
FIG. 10 shows, in perspective, a partially exploded view of the container of FIG. 7 and an enlarged detail of the container seen from an alternative perspective.
Figure 11:
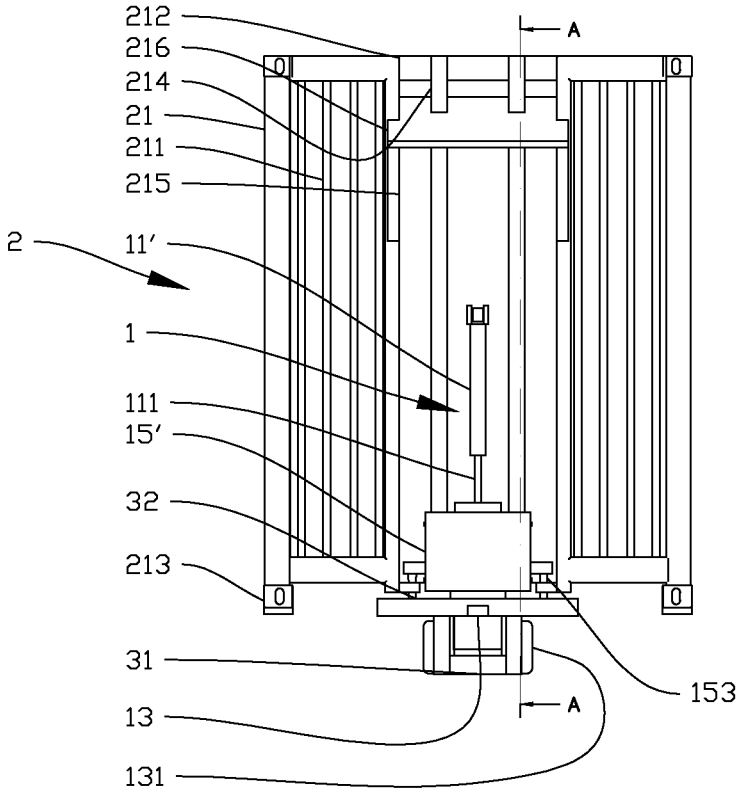
FIG. 11 shows an end surface of the container of FIG. 7, in a side view.
Figure 12:
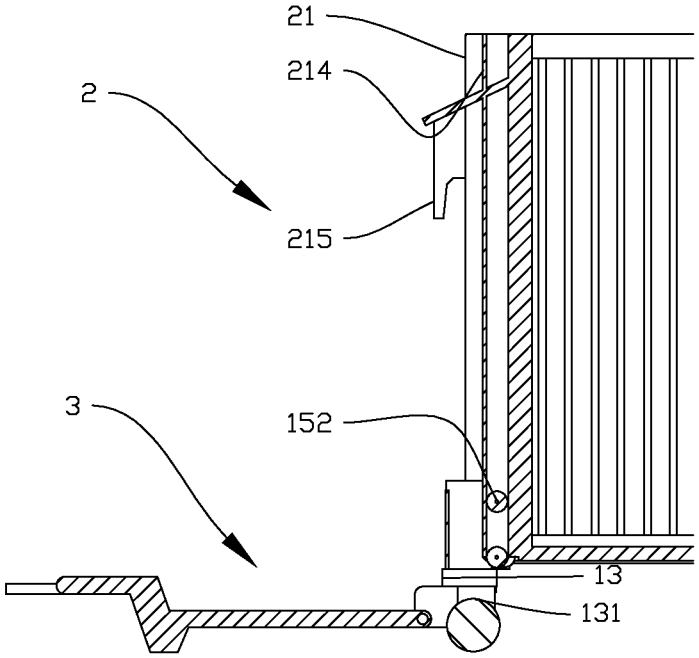
FIG. 12 shows a section of the container of FIG. 7 viewed through the line A-A of FIG. 11.

In what follows, the reference numeral 1 describes a lifting device according to the invention, whereas the reference numeral 2 describes a container with the lifting device 1 attached to it. The lifting device may be an integrated part of a container 2 or the lifting device 1 may have been retro-fitted to an existing container 2. The lifting device 1 is attached at one end 21 of the container 2. In the figures, the lifting device 1 is shown as being attached to one side surface 211 of the container 2. More specifically, the lifting device 1 is shown as partially positioned in a recess 212 in the side surface 211. Thereby, the container 2 with the lifting device 1 attached to it substantially will not take up more space than a container 2 without a lifting device 1, so that the container 2 with the lifting device 1 may be positioned on a transport vehicle in the same way and by the same equipment as for existing containers 2 without lifting devices (not shown). The lifting device 1 is further provided with an actuator 11, shown as a hydraulic cylinder 11 in the figures. The hydraulic cylinder 11 may, for example, be connected to the hydraulic system of a tractor or a construction site engine in a manner (not shown) known to the person skilled in the art. In alternative embodiments, the actuator 11 may also be of a mechanical or pneumatic type (non shown). The actuator 11 is shown as placed in a protective frame 15. Through an opening 151 in the actuator frame 15, the actuator 11 is connected to a bracket 14 via a connecting body 12. The connecting body 12, which may be, for example, a rectangular pipe or the like, is attached to the actuator 11 and movable therewith. The bracket 14 is surrounded, at least partially, by a collar 141 with a lug 143 projecting on either side of the collar 141. On its underside, the bracket 14 is further connected to an undercarriage 13 of the lifting device 1, the undercarriage 13 being rotatable around a shaft 133 between the bracket 14 and the undercarriage 13. The undercarriage 13 is also provided with one or more wheels 131, shown as two wheels 131 in the figures. The lifting device 1 is further provided with a tow-bar 3. In the figures, the tow-bar 3 is shown as being attached to the undercarriage 13 and rotatable therewith. The tow-bar 3 is attached to the undercarriage 13 in a manner known to the person skilled in the art. In addition to being rotatable around the shaft 133, the tow-bar 3 can also be adjusted between a raised position, see FIGS. 1, 2 and 5, and a lowered position, see FIGS. 3 and 6. In the FIGS. 1 and 5, the lifting device 1 is shown in a first (upper) position so that the wheels 131 on the undercarriage 13 substantially are not in contact with the supporting surface. When the lifting device 1 is in the first (upper) position, the side surface 211, at which the lifting device 1 is attached, is resting on a pair of supporting legs 213 spaced apart at one end 21 of the container. In the FIGS. 2, 3 and 6, the actuator 11 is shown in a second (lower) position with the wheels 131 on the undercarriage 13 moved downwards into engagement with the supporting surface, so that one end 21 of the container 2 is lifted up. The container 2 is thereby resting partly on the wheels 131. An opposite end 23 of the container 2 is shown as supported by a set of spaced-apart wheels 231 attached at that other end 23 of the container 2, so that, when the lifting device 1 is in the second position, engaging the supporting surface, the container 2 is resting on wheels 131, 231 placed at two opposite ends 21, 23 of the container. The container 2 is thereby arranged to be moved on wheels. The tow-bar 3 is further provided with a transverse bar 32. When the tow-bar 3 is in its raised position and the lifting device 1 is in the first (upper) position, the transverse bar 32 may engage a pair of upper locking dogs 215 on the container 2. Thus, the tow-bar 3 may be locked to the container 2 when not in use. In the lowered position, and with the container 2 resting on wheels 131, 231, the tow-bar 3 may be attached to, for example, but not limited to, a tractor or a construction site engine (not shown). For example, the tow-bar 3 may be attached to the vehicle by means of the transverse bar 32 or a split pin or the like (not shown) extending through the eye 33 on the tow-bar 3. The container 2 may thereby easily be pulled to a new location by means of the tow-bar 3 and a vehicle (not shown). The tow-bar 3 is also shown as provided with a hook connection element 31 on the side facing away from the container 2 when the tow-bar 3 is in the raised position. The hook connection element 31 may be gripped by, for example, a hook on a hook-lift truck or the like, so that the container 2 can be lifted onto the hook-lift truck and carried away in a known manner (not shown). When the tow-bar 3 is in the lowered position, the hook connection element 31 may also function as a support for the tow-bar 3. Further, the container 2 is shown as being provided with a lower set of locking dogs 217. The lugs 143 are arranged to engage with the lower locking dogs 217 as the lifting device 1 is moved into the second (lower) position, so that the locking dogs and lugs provide a lower locking device. Thus, the load from the tow-bar 3 on the container 2, when being pulled, will substantially be distributed between the lugs 143 in the locking dogs 217 so that the connecting body 12 between the bracket 14 and the actuator 11 is relieved.

FIGS. 7-12 show an alternative embodiment of a lifting device 1 according to the invention. A connecting body 12' is connected to the rod 111 of an actuator 11' by a connector part 112 on the rod 11 being connected to a connector part 122 on the connecting body 12' by means of a bolt or the like, not shown. Thus, the connecting body 12' is movable together with the actuator 11'. Further, the connecting body 12' is fixedly attached to the inside of a protective frame 15' so that the frame 15', too, is movable together with the actuator 11'. The connecting body 12' may be attached to the frame 15' by a prior-art technique, for example by welding or by means of one or more screws or bolts. A set of wheels 152 on the frame 15' is adapted for and placed in two U-shaped profiles 214 placed in the recess 212 of the container, so that the wheels 152 run inside the profiles 214 when the connecting body 12' and, thus, also the frame 15' are being moved with the actuator 11'. The U-profiles 214 are shown with the openings facing outwards, whereas, in an embodiment not shown, the opening of the U-profiles 214 may possibly face inwards. The frame 15' is shown enlarged and in an alternative perspective, so that the wheels 152 are visible, at the bottom of FIG. 10. A protective roof 216 is placed over the lifting device 1, at the end 21 of the container 2, so that the lifting device 1 lies at least partially protected within the recess 212 and under the roof 216. Further, the frame 15' is shown as provided with two locking pins 153 projecting downwards, arranged to engage a set of locking eyes 218 on the container 2 when the lifting device 1 is moved into its first position, engaging the supporting surface, so that the actuator 11' is relieved when the container 2 is being pulled, as shown best in the exploded sketch in FIG. 10, and in FIG. 11. The locking pins 153 and locking eyes 218 thus form a lower locking device.

The invention claimed is:

1. A lifting device for a container disposed on a supporting surface, the lifting device being attached at one end of the container, the lifting device comprising:

an undercarriage provided with one or more wheels engageable and disengageable with the supporting surface;

a tow-bar connected to the undercarriage; and an actuator arranged to move the undercarriage of the lifting device between a first position, not engaging the supporting surface, and a second position, engaging the supporting surface, so that, in the position of the undercarriage engaging the supporting surface, one end of the container is lifted up from the supporting surface, wherein the undercarriage of the lifting device is connected to the actuator via at least one connecting body, the connecting body being connected to the actuator by means of a connector, and the connecting body being linearly movable with the actuator, wherein the undercarriage is rotatable relative to the connecting body around a shaft normal to the supporting surface;

wherein the actuator and the connecting body are at least partially placed within a protective frame, so that forces acting on the actuator may be distributed to the connecting body and the frame, and wherein, in the first position, the tow-bar is configured to be held in a raised position in locking engagement with the container, and, in the second position, the tow-bar is configured to be moved out of locking engagement with the container enabling the tow-bar to move to a lowered position away from the container.

2. The lifting device in accordance with claim 1, wherein at least one of the frame and the connecting body is formed with a non-circular cross-section.

3. The lifting device in accordance with claim 2, wherein the connecting body is a pipe with a rectangular cross-section.

4. The lifting device in accordance with claim 1, wherein, on a side facing away from the actuator, the connecting body is further connected to a bracket to which the undercarriage is connected.

5. The lifting device in accordance with claim 1, wherein the tow-bar is vertically rotatable relative to the undercarriage, whereby the tow-bar is adjustable between at least the raised position and the lowered position.

6. The lifting device in accordance with claim 4, wherein, on aside facing away from the container in the raised position, the tow-bar is formed with a hook connection element, whereby the container may be lifted by a hook-lift truck when the undercarriage is in the first position not engaging the supporting surface, and the tow-bar is in the raised position.

7. The lifting device in accordance with claim 1, wherein the tow-bar is formed with an eye, whereby the container may be pulled by a vehicle when the undercarriage is in the second position engaging the supporting surface, and the tow-bar is in the lowered position.

8. The lifting device in accordance with claim 1, wherein the tow-bar is provided with a transverse bar engaged with upper locking dogs on the container when the undercarriage is moved to the first position not engaging the supporting surface and the tow-bar is in the raised position, whereby the tow-bar can be locked to the container.

9. The lifting device in accordance with claim 8, wherein the transverse bar is released from the upper locking dogs when the undercarriage is moved to the second position engaging the supporting surface, whereby the tow-bar is releasable from the container upon moving the undercarriage into the second position engaging the supporting surface.

10. The lifting device in accordance with claim 1, wherein the lifting device is provided with lugs engaged with lower locking dogs on the container when the undercarriage is moved to the second position engaging the supporting surface.

11. The lifting device in accordance with claim 1, wherein the lifting device is provided with locking pins engaged with locking eyes on the container when the undercarriage is moved to the second position engaging the supporting surface.

12. The lifting device in accordance with claim 1, wherein the actuator is a hydraulic cylinder.

* * * * *